US006276382B1

(12) United States Patent
Bindschatel et al.

(10) Patent No.: US 6,276,382 B1
(45) Date of Patent: Aug. 21, 2001

(54) ADJUSTABLE CANOPY AND PIVOTABLE PICNIC TABLE

(76) Inventors: Lyle D. Bindschatel; Debra L. Bindschatel, both of 1768 Savannah St., Louisville, TN (US) 37777

( * ) Notice: Subject to any disclaimer, the term of this patent is extended or adjusted under 35 U.S.C. 154(b) by 0 days.

(21) Appl. No.: 09/722,159

(22) Filed: Nov. 27, 2000

(51) Int. Cl.[7] ..... A47B 37/04

(52) U.S. Cl. ..... 135/96; 135/124; 135/906; 108/50.12

(58) Field of Search ..... 135/96, 124, 138, 135/906; 108/50.12; 297/184.15, 184.17

(56) References Cited

U.S. PATENT DOCUMENTS 2,362,567 * 11/1944 La Rue .
3,051,185 * 8/1962 Reynolds ..... 135/124
3,307,565 * 3/1967 Luccarelli ..... 108/50.12 X
4,051,638 * 10/1977 Heintz ..... 52/63
4,621,865 * 11/1986 Herrera .
5,494,329 * 2/1996 Gonzalez et al. ..... 297/184.13
5,832,943 * 11/1998 Johnson ..... 135/124

* cited by examiner

*Primary Examiner*—Robert Canfield

(57) ABSTRACT

An Adjustable Canopy, for use in combination with a picnic table or the like, to protect the users from the elements and which is quickly and easily removable in anticipation of severe conditions.

Furthermore, a new design of Picnic Table, for use with the Adjustable Canopy, which has no significant obstructions to entry or exit and which can be Pivotable, thereby allowing an unlimited range of adjustments to impede the elements, regardless of the originating direction.

3 Claims, 2 Drawing Sheets

ADJUSTABLE CANOPY AND PIVOTABLE PICNIC TABLE

FIELD OF THE INVENTION

This invention relates to an adjustable means of protection from elements such as sun, rain, bird droppings, etc. while outdoors seated at a picnic table or the like.

This invention further relates to an improved picnic table which is pivotable. When combined with the adjustable canopy, the user can pivot the table and adjust the canopy to block the sun's rays from any direction.

BACKGROUND AND PRIOR ART

Previously, there have been no simple means to protect people seated at a picnic table or, the like from the sun's rays at any time of day, from the rain or wind originating from diverse directions, from bird droppings, or from other potential hazards of sitting outdoors.

Free-standing canopies only provide protection from the sun during a short period of the day and not during earlier morning and later afternoon hours when the sun is low in the sky. They provide no protection from the wind or from driving rain.

Canopies which are fastened to a structure such as a wall or a camper trailer similarly provide only limited protection from the sun and rain and no protection from wind.

Previous inventions for canopies attached to a table or chair are mostly not adjustable. The few canopies which are adjustable are impractical, difficult to install and adjust.

Prior art picnic tables in general can only be moved by being dragged along the ground or by being lifted off the ground by two or more people, both difficult to do. Additionally, most picnic tables cannot be easily adapted to be pivotable.

The following inventions were found in Prior Art:

| | | | |
|---|---|---|---|
| D 279,833 | 07/30/85 | Eberle | D3/5 |
| D 290,315 | 06/16/87 | Swenson et. al. | D6/337 |
| 4,036,244 | 07/19/77 | Huddle | 135/4R |
| 4,096,874 | 06/27/78 | Weatherly | 135/5R |
| 4,621,865 | 11/11/86 | Herrera | 297/184 |
| 4,724,882 | 02/16/88 | Wang | 160/69 |
| 4,915,120 | 04/10/90 | Zjolkowskj | 135/90 |
| 4,924,896 | 05/15/90 | Carter | 135/90 |
| 5,135,281 | 08/04/92 | Pappalardo | 297/184 |
| 5,215,108 | 06/01/93 | Sprague | 135/90 |
| 5,823,217 | 10/20/98 | Rice | 135/124 |
| 5,832,943 | 11/10/98 | Johnson | 135/124 |
| 6,109,280 | 08/29/00 | Custer | 135/116 |

Wang shows an awning with a horizontal center pivot, two flat awning sides, and a cog-driven mechanism for retraction. The height of the entire unit has a limited adjustment. Each awning side can be tilted to a limited degree. When used in combination with a picnic table or the like, each awning side would have to be quite large to overhang and protect users seated at opposite sides of the table. Wang's awning would not provide protection from wind and is probably unusable except in light wind conditions. In addition, it cannot tilt sufficiently to block the sun's rays when low in the sky or to obstruct blowing rain.

Ziolkowski shows an adjustable bonnet for lawn chairs which is impractical. If one user positions his chair to face away from the sun, the bonnet works reasonably well. However if a second person faces the first to converse, he is facing the sun, and this invention would block his view of the first user when adjusted to block the sun. Pivoting the bonnet forward also impedes the user's entry or exit from the chair. Pivoting the bonnet to a greater degree forward or backward than shown in FIG. 1 causes the bonnet to collapse together since the bows pivot closer together. If applied to a picnic table, either lengthwise or crosswise, this bonnet would impede the entry and exit of the users unless it is in the closed position on the side or end of entry or exit. To apply to a picnic table, numerous additional bows and additional covering would be necessary to protect all users from the elements and their view beyond the table would be completely obstructed by the bonnet.

Pappalardo's shade has all the disadvantages of Ziolkowski's bonnet and more. It is adjustable in only one direction. It cannot be applied to a picnic table to protect its users from the elements without numerous modifications.

Rice shows a Sunshade which has only two arrangements, assembled or disassembled, i.e. it is not adjustable. If a user needs to block the sun as it changes angles, he would have to get up and literally pick up the entire unit to change its position. If this sunshade were large enough for a picnic table to fit inside, it would certainly be cumbersome to do this.

None of the above-mentioned inventions satisfactorily meets the requirements for a canopy adjustable to a wide range of positions, or combined with a pivotable picnic table to provide unlimited positions which do not impede entry or exit.

OBJECTS OF THE INVENTION

The primary object of this invention is to provide a canopy for use in combination with a picnic table or the like, which is quickly and easily adjustable to a wide range of positions to protect the users from the ultra-violet rays and glare of the sun at any time of day, or from rain or wind, or from bird droppings, while seated outdoors.

Another object of this invention is to provide an adjustable canopy for use in combination with a picnic table or the like which is quickly and easily installed, and quickly and easily removable in the event of severe weather such as heavy snow, high winds, or hail.

An additional object of this invention is to provide a picnic table which is structurally sturdy and has no substantial obstructions to entry or exit.

A further object of this invention is to provide a picnic table which is easily pivotable and when combined with the adjustable canopy, protects the users from the elements regardless of the direction from which they originate.

DESCRIPTION OF THE INVENTION

Figure 1:
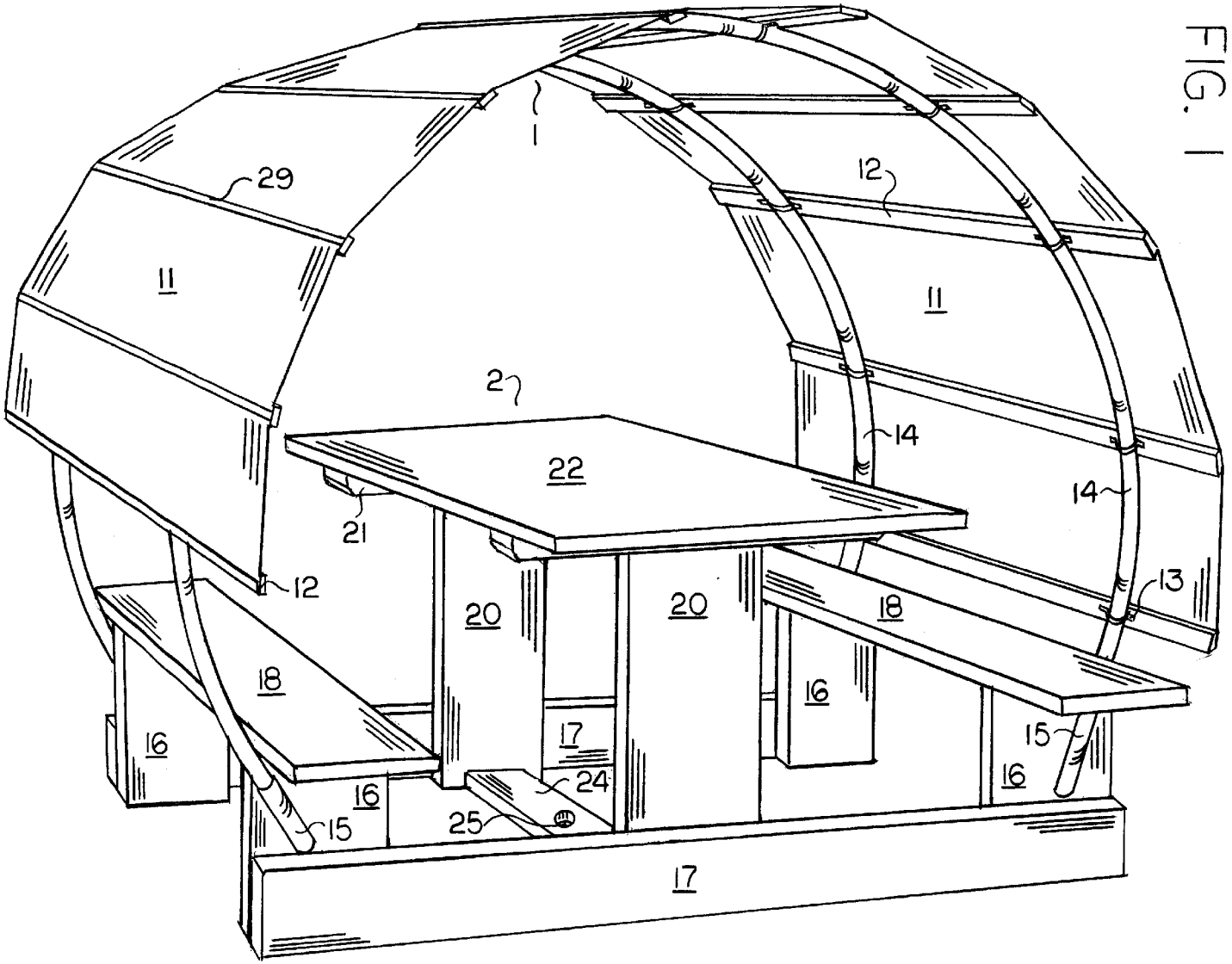
FIG. 1 is a perspective view of the Adjustable Canopy of this invention as attached to the Pivotable Picnic Table, with the Adjustable Canopy shown in the fully extended position.

The Adjustable Canopy 1 of this invention comprises a pliable cover 11 attached to a plurality of ribs 12. Each rib 12 has at least two hoop guides 13. Each hoop guide 13 glides along a hoop 14. The two ends of each hoop 14 fit a hoop receiver 15 attached to opposite seat supports 16 of the Picnic Table 2, as shown in FIG. 1.

In the preferred embodiment, the hoops 14 are tubular and arc-shaped. The hoop receivers 15 are tubular with an inside diameter slightly larger than the outside diameter of the hoop 14 so that one end of the hoop 14 is received inside the hoop receiver 15 at least a few inches. One hoop receiver 15 is fastened to each seat support 16 at an angle upward and outward from its outer edge.

The plurality of ribs 12 are equally spaced horizontally along the cover 11. In the preferred embodiment, rib caps 29 are used to fasten the cover 11 to the ribs 12. The rib caps 29 are the same length as the ribs 12.

In the embodiment shown, two hoops 14 are used. Two hoop guides 13 are attached to each rib 12 at an equal distance from its opposite ends. The distance between the two hoop guides 13 on each rib 12 must correspond to the distance between the hoop receivers 15. The hoop guides 13 are a U-shape somewhat larger than the outside diameter of the hoop 14 with a perpendicular projection at each end through which an appropriate fastener such as a screw can secure the hoop guide 13 to the rib 12.

Figure 2:
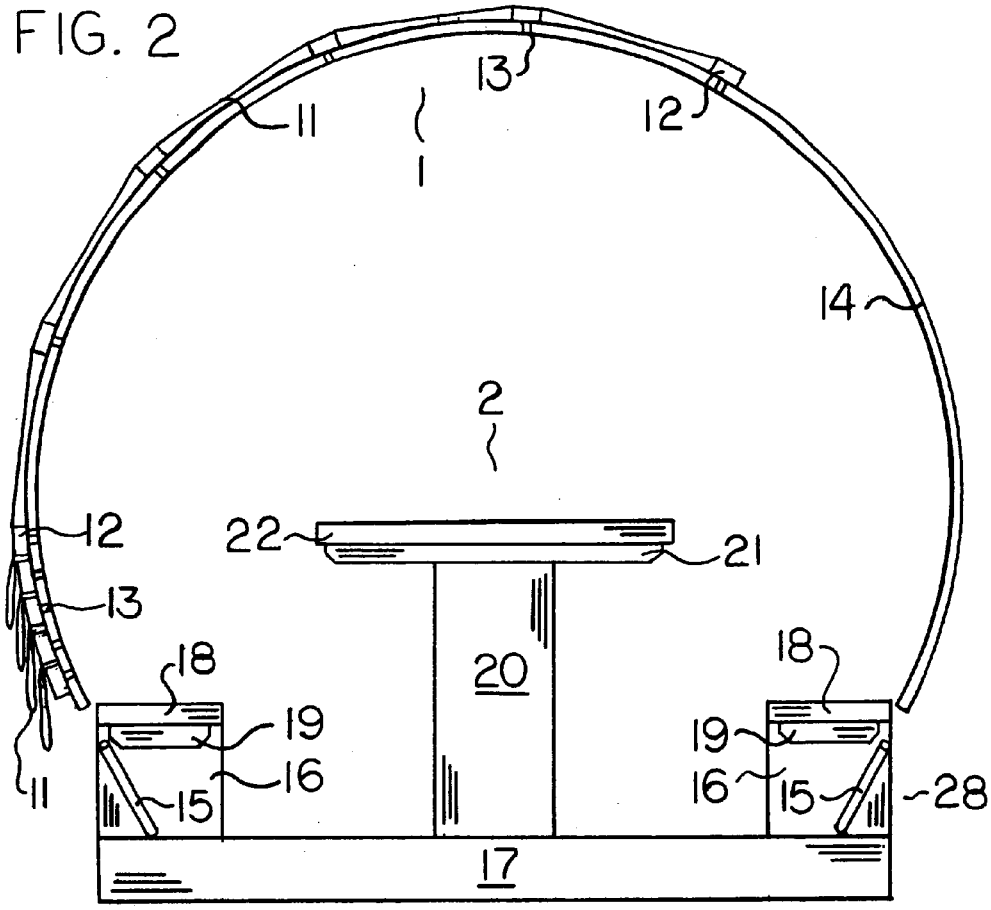
FIG. 2 is an end view of the Adjustable Canopy of this invention as attached to a picnic table and shown in a partially extended position.

To adjust the position of the Adjustable Canopy 1, the user simply grasps a rib 12 at or near its center and it will glide along the hoops 14 in the direction in which it is pulled. As shown in FIG. 2, the cover 11 may begin to fold or pleaton one side. The Adjustable Canopy 1 may be completely folded if the user wishes.

To assemble the Adjustable Canopy 1, begin by inserting the distal end of each hoop 14 into a hoop receiver 15 of seat supports 16 on the distal side of the picnic table 2. The hoop guides 13 of a rib 12 are slid onto the hoops 14, each rib 12 in sequence, then the proximal end of each hoop 14 is inserted into its corresponding hoop receiver 15 of the seat supports 16 on the proximal side of the picnic table 2. Disassembly is simply the reverse, and is quick and easy to do in the anticipation of severe weather such as heavy snowfall, high winds, or hail.

The preferred embodiment for the Picnic Table 2 of this invention is sturdily constructed and is designed for easier entry and exit than the standard A-frame picnic table, in addition to being pivotable.

At least two table braces 21 are fastened to the underside of the table top 22, perpendicular to the length of the table top 22 and at equal distances from the ends of the table top 22.

At least two seat braces 19 are fastened to the underside of each seat 18, perpendicular to the length of the seat 18 and at equal distances from the ends of the seat 18. The distance between the seat braces 19 is equal to the distance between the table braces 21 since the seats 18 are the same length as the table top 22.

One end of one table support 20 is fastened perpendicularly to one leg set brace 17 at the center. Two seat supports 16 are fastened to a leg set brace 17, one at each end and perpendicular to the leg set brace 17. This assembly is the leg set 28.

Each leg set 28 can then be attached to the table top 22 by fastening the top end of the table support 20 to the side of the table brace 21. Each seat 18 is attached to each leg set 28 by fastening the top end of the seat support 16 to the side of the seat brace 19.

Figure 3:
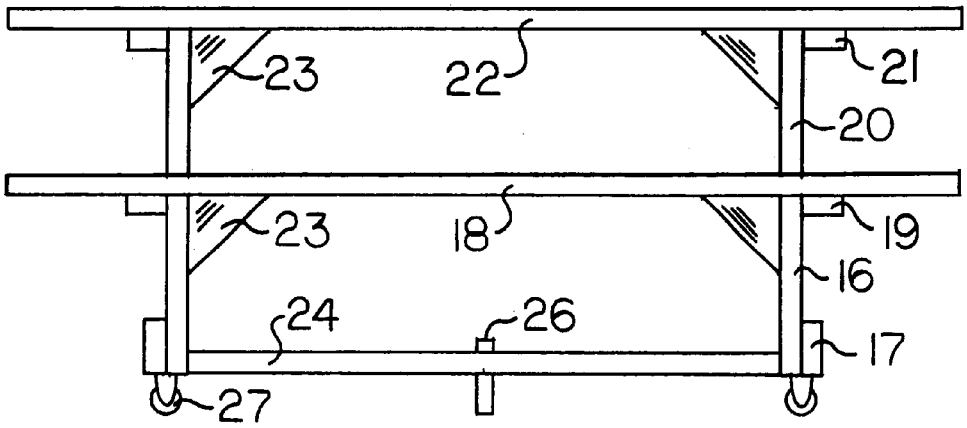
FIG. 3 is a side view of the Pivotable Picnic Table of this invention.

For added stability, a plurality of stabilizing braces 23 are provided. One stabilizing brace 23 is fastened to each table support 20 and the table top 22. One stabilizing brace 23 is fastened to each seat support 16 and the seat 18, as shown in FIG. 3.

A cross-member 24 has a through-hole 25 at its center. The cross-member 24 is fastened at each end to the bottom end of each table support 20 perpendicular to each table support 20 and in a plane parallel to the table top 22.

One caster 27 is fastened to the bottom end of each seat support 16.

In the preferred embodiment, the Picnic Table 2 is situated on a deck or slab and a hole is made the same diameter as the through-hole 25. The pivot pin 26 is then slid through the hole 25 of the cross-member 24 and into the hole in the deck or slab. This enables the entire Picnic Table 2 to easily pivot around the pivot pin 26 on the casters 27.

When the Adjustable Canopy 1 is combined with the Pivotable Picnic Table 2, there is an unlimited range of positions to block the elements regardless of the direction it originates from.

While the above description contains specificities, these should not be construed as limitations on the scope of this invention, but rather as an example of one preferred embodiment thereof. Variations are possible, for example, a longer picnic table may need a third leg set for center support, a third hoop, and a third hoop guide on each rib. Some materials used for the cover may not need rib caps, but may be directly fastened to the ribs. For use on standard A-frame picnic tables, a pair of wood blocks for each hoop can have hoop receivers drilled and those blocks can be fastened to the frame or underneath the seats at the distance apart corresponding to the hoop guides on the ribs.

Accordingly, the scope of this invention should be determined not by the embodiment illustrated, but by the appended claims and their legal equivalent.

Having thus described the aforementioned invention.

We claim:

1. An Adjustable Canopy, in combination with an existing picnic table, said existing picnic table having at least two pairs of existing opposite seat supports, said Adjustable Canopy comprising:

at least two pairs of hoop receivers, one of each said pairs of hoop receivers being fastened to one of each said existing pairs of opposite seat supports of said existing picnic table, said hoop receivers being tubular;

one hoop for each said pair of hoop receivers, said hoop being tubular and arc-shaped, the outside diameter of said hoop being slightly smaller than the inside diameter of said hoop receiver, each one of said pair of hoop receivers receiving one end of said hoop within;

a pliable cover fastened to a plurality of ribs, said ribs equally spaced length-wise and placed horizontally across said cover, each of said plurality of ribs having at least two hoop guides, the distance between said hoop guides corresponding to the distance between said hoop receivers, each of said hoop guides being U-shaped and slightly larger than the outside diameter of said hoop, each of said hoop guides having a perpendicular projection at each end, each said projection on one of-said hoop guides being fastened to one of said ribs, one said hoop guide on each said rib sliding onto and gliding upon one said hoop.

2. The Adjustable Canopy of claim 1 combined with a Picnic Table comprising:

a table top and at least two table braces, said table braces being fastened to the underside of said table top, one said table brace near each end of said table top and perpendicular to the length of said table top;

two seats and at least four seats braces, each said seat parallel to the length of said table top, at least two said seat braces being fastened to the underside of each of said seats and perpendicular to the length of each of said seats, said seat braces being located a distance apart equal to the distance between said table braces;

at least two leg sets, each said leg set comprising a leg set brace, a table support, and two seat supports; the bottom end of said table support being fastened perpendicularly to said leg set brace at the center of said leg set brace, the bottom end of the first said seat support being fastened perpendicularly at first end of said leg set brace, the bottom end of second said seat support being fastened perpendicularly at second end of said leg set brace, said seat supports and said table support being in a plane parallel to said leg set brace; the upper end of said table support being fastened to the side of one said table brace at the center of said table brace in a plane perpendicular to said table top, the upper end of said first seat support being fastened to the side of one said seat brace of first said seat, the upper end of second said seat support being fastened to the side of one said seat brace of second said seat, said seat supports being in a plane perpendicular to said seats;

a plurality of stabilizing braces, one of said stabilizing braces being fastened to one said table support and said table top in a plane perpendicular to said table support and said table top, one of said stabilizing braces being fastened to one of said seat supports and one said seat in a plane perpendicular to said seat support and said seat.

3. The Adjustable Canopy combined with the Picnic Table of claim 2, for use in combination with an existing deck, slab, or level ground, further comprising:

a cross-member having a center through-hole, said cross-member being fastened at each end to said leg sets at the bottom center of said table supports in a plane parallel to said table top;

a pivot pin of slightly smaller diameter than said through-hole in said cross-member, said pivot pin passing through said through-hole perpendicular to said cross-member and into a corresponding hole in said existing deck, slab, or ground;

a plurality of casters, one said caster being fastened to the bottom end of one of said seat supports.

* * * * *